US011155101B2

(12) United States Patent
Hirano et al.

(10) Patent No.: US 11,155,101 B2
(45) Date of Patent: Oct. 26, 2021

(54) TABLET PRINTING APPARATUS AND HEAT DISSIPATION METHOD THEREOF

(71) Applicant: SHIBAURA MECHATRONICS CORPORATION, Yokohama (JP)

(72) Inventors: Azusa Hirano, Yokohama (JP); Yasutsugu Tsuruoka, Yokohama (JP)

(73) Assignee: SHIBAURA MECHATRONICS CORPORATION, Yokohama (JP)

( * ) Notice: Subject to any disclaimer, the term of this patent is extended or adjusted under 35 U.S.C. 154(b) by 0 days.

(21) Appl. No.: 16/807,241

(22) Filed: Mar. 3, 2020

(65) Prior Publication Data

US 2020/0282747 A1 Sep. 10, 2020

(30) Foreign Application Priority Data

Mar. 8, 2019 (JP) ..... JP2019-042360

(51) Int. Cl.
*B41J 3/407* (2006.01)

(52) U.S. Cl.
CPC ..... *B41J 3/4073* (2013.01)

(58) Field of Classification Search
CPC ..... B41J 3/4073
See application file for complete search history.

(56) References Cited

U.S. PATENT DOCUMENTS

2012/0013669 A1* 1/2012 Toya ..... B41J 11/0024 347/16
2014/0267519 A1 9/2014 Suzuki
2016/0243857 A1* 8/2016 Otsuka ..... B41J 2/1714
2016/0288554 A1* 10/2016 Nakamura ..... B41J 2/175
2018/0229493 A1 8/2018 Hirano et al.

FOREIGN PATENT DOCUMENTS

CN 101943041 A 1/2011
CN 108909196 A 11/2018
JP 2014-181082 A 9/2014
JP 2016-141515 A 8/2016

* cited by examiner

*Primary Examiner* — Justin Seo
(74) *Attorney, Agent, or Firm* — Oblon, McClelland, Maier & Neustadt, L.L.P.

(57) ABSTRACT

According to one embodiment, a tablet printing apparatus includes: a conveyor configured to convey a tablet while sucking and holding the tablet by the discharge of air; an inkjet head configured to perform printing on the tablet conveyed by the conveyor; an exhaust pipe which the air discharged from the conveyor passes through; an exhaust blower as a heat source that generates heat; a heat conductive member that is in contact with the exhaust pipe and the exhaust blower; and a housing configured to house the conveyor, the inkjet head, the exhaust pipe, the exhaust blower, and the heat conductive member.

20 Claims, 5 Drawing Sheets

TABLET PRINTING APPARATUS AND HEAT DISSIPATION METHOD THEREOF

CROSS-REFERENCE TO THE RELATED APPLICATION

This application is based upon and claims the benefit of priority from Japanese Patent Applications No. 2019-042360, filed on Mar. 8, 2019; the entire contents of all of which are incorporated herein by reference.

FIELD

Embodiments described herein relate generally to a tablet printing apparatus and a heat dissipation method thereof.

BACKGROUND

A printing technique that uses an inkjet print head is known for printing identification information (one example of information) such as characters, letters, marks, etc. on a tablet. In a tablet printing apparatus using this technique, tablets are conveyed by a conveying device such as a conveyor. Ink is ejected from each nozzle of the inkjet print head located above the conveying device toward each tablet passing under the inkjet head to print identification information on the tablet.

In the housing of the tablet printing apparatus, there is a heat source such as a motor that serves as a driving source. Therefore, inside the housing, the temperature tends to rise, which causes ink drying at the nozzle tip of the inkjet head and around the nozzles. If the nozzles are used in a state where the ink is dry, an ink ejection failure may occur. For example, the trajectory of the ink ejected from the nozzles may be crooked or the amount of ejected ink may be insufficient. As a result, tablets with print defects are produced, resulting in a decrease in productivity.

DETAILED DESCRIPTION

According to one embodiment, a tablet printing apparatus includes:

a conveyor configured to convey a tablet while sucking and holding the tablet by the discharge of air;

an inkjet head configured to perform printing on the tablet conveyed by the conveyor;

an exhaust pipe which the air discharged from the conveyor passes through;

a heat source that generates heat;

a heat conductive member that is in contact with the exhaust pipe and the heat source; and a housing configured to house the conveyor, the inkjet head, the exhaust pipe, the heat source, and the heat conductive member.

According to another embodiment, a heat dissipation method of a tablet printing apparatus that includes a conveyor configured to convey a tablet while sucking and holding the tablet by the discharge of air, an inkjet head configured to perform printing on the tablet conveyed by the conveyor, an exhaust pipe which the air discharged from the conveyor passes through, a heat source that generates heat, and a housing configured to house the conveyor, the inkjet head, the exhaust pipe, and the heat source, the method includes:

transferring the heat generated by the heat source to the exhaust pipe through a heat conductive member that is arranged in contact with the exhaust pipe and the heat source.

First Embodiment

A first embodiment will be described with reference to FIGS. 1 to 5.

(Basic Configuration)

Figure 1:
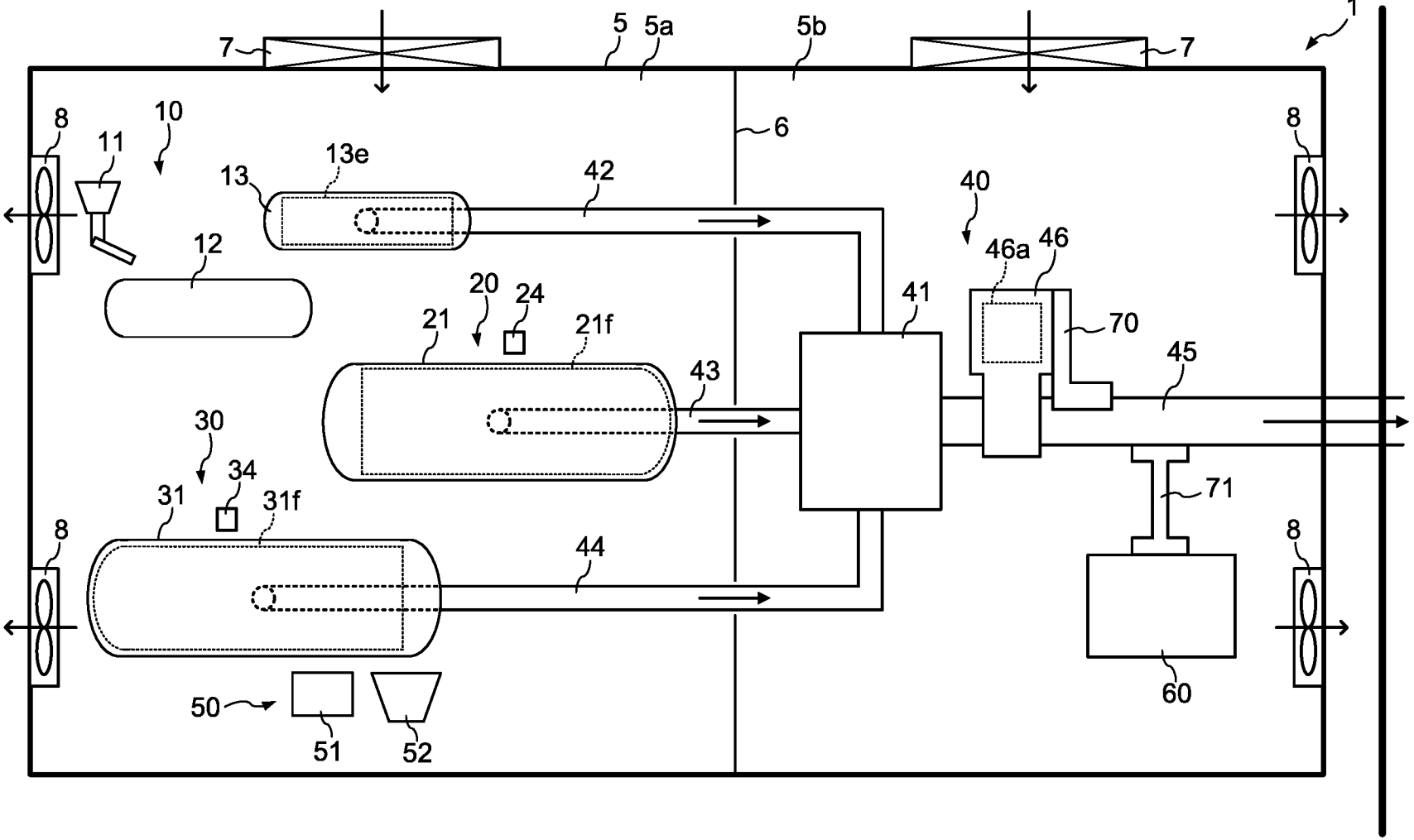
FIG. 1 is a diagram illustrating a tablet printing apparatus according to a first embodiment.
Figure 2:
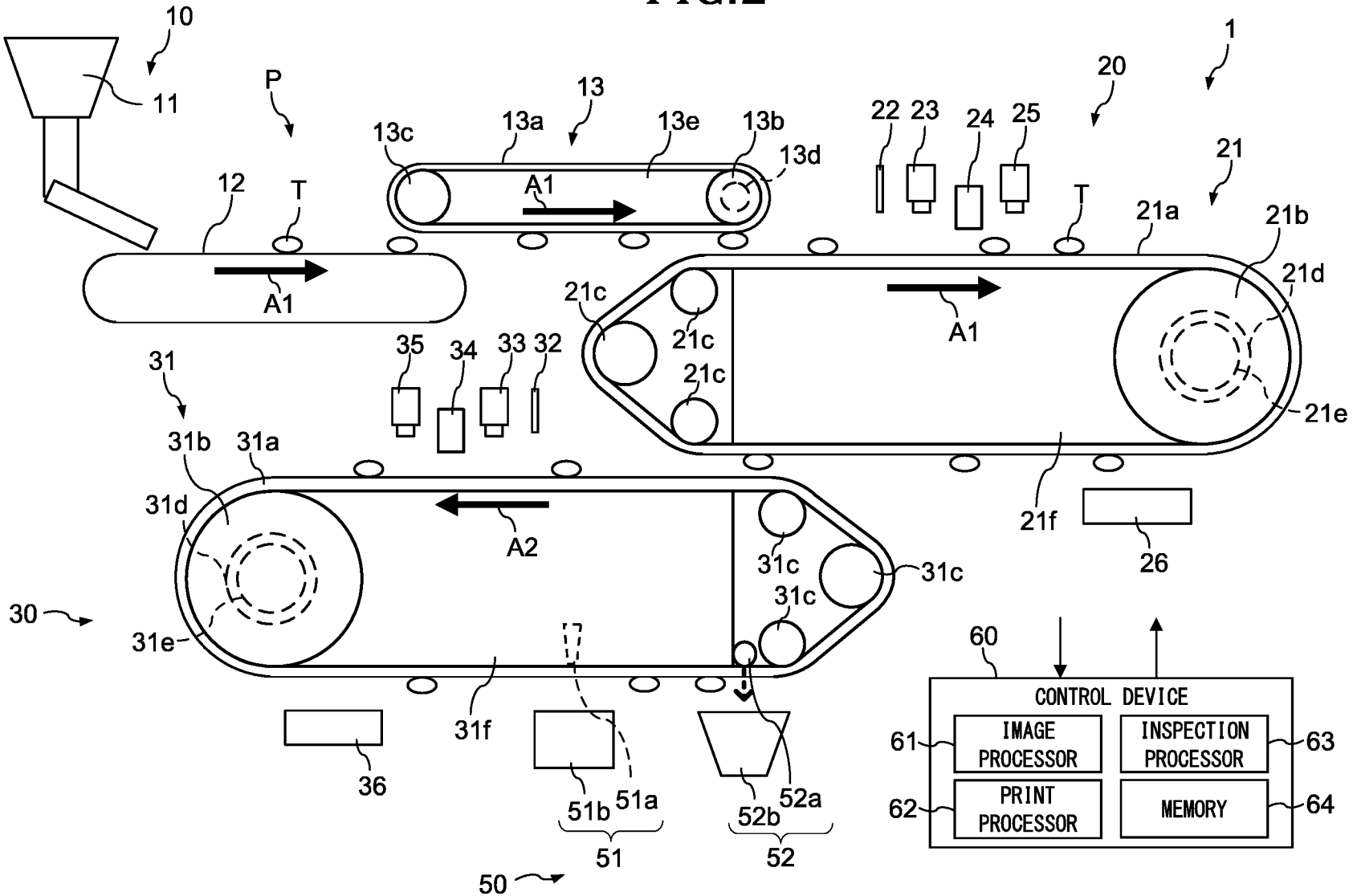
FIG. 2 is a diagram illustrating a part of the tablet printing apparatus of the first embodiment.

As illustrated in FIGS. 1 and 2, a tablet printing apparatus 1 of the embodiment includes a housing 5, a supply device (supplier) 10, a first printing device (printer) 20, a second printing device (printer) 30, an exhaust device (exhauster) 40, a collecting device (collector) 50, and a control device (controller) 60.

As illustrated in FIG. 2, the supply device 10, the first printing device 20, the second printing device 30, and the collecting device 50, each of which is a constituent element of the tablet printing apparatus 1, are arranged in this order to form a conveying path P for conveying tablets T, and a series of processes: supply, printing, and collection of tablets T are performed along the conveying path P. In this embodiment, the upstream of the conveying path P is the supply device 10 side, while the downstream of the conveying path P is the collecting device 50 side.

As illustrated in FIG. 1, the housing 5 is formed in, for example, a box shape, and houses the supply device 10, the first printing device 20, the second printing device 30, the exhaust device 40, the collecting device 50, the control device 60, and the like. The inside of the housing 5 is divided by a partition plate 6 serving as a partition wall into two chambers: a first chamber 5*a* and a second chamber 5*b*. The first chamber 5*a* houses the supply device 10, the first printing device 20, the second printing device 30, part of the exhaust device 40 (part of exhaust pipes 42 to 44), the collecting device 50, and the like. The second chamber 5*b* houses part of the exhaust device 40 (an exhaust box 41, part of the exhaust pipes 42 to 45, an exhaust blower 46), the control device 60, and the like. The partition plate 6 is provided to prevent the powder of the tablets T generated in the first chamber 5*a* from entering the second chamber 5*b*. Since precision equipment such as the control device 60 is arranged in the second chamber 5*b*, this is for preventing the powder of the tablets T from adhering thereto.

A plurality of filters 7 (two in the example of FIG. 1) such as high-efficiency particulate air (HEPA) filters are arranged on the upper surface of the housing 5. A plurality of fans 8 (four in the example of FIG. 1) are arranged on the side surface of the housing 5. The filters 7 purify downflow air that comes down from the ceiling of the installation room (for example, a clean room) where the housing 5 is installed, and let the downflow air into the housing 5. The fans 8 discharge air from the inside of the housing 5 in order to suppress a temperature rise, contamination, and the like in the housing 5. The fans 8 are electrically connected to the control device 60, and are driven under the control of the control device 60.

As illustrated in FIG. 2, the supply device 10 includes a hopper 11, an alignment feeder 12, and a transfer feeder (conveyor) 13. The supply device 10 is configured to be capable of supplying tablets T to be printed to the first printing device 20, and is located at one end of the first printing device 20. The hopper 11 stores a number of tablets T and sequentially supplies the tablets T to the alignment feeder 12. The alignment feeder 12 aligns the supplied tablets T in a row and conveys them to the transfer feeder 13. The transfer feeder 13 sequentially sucks the tablets T aligned in a row on the alignment feeder from above to hold them. The transfer feeder 13 conveys the tablets T in a row to the first printing device 20 while holding them, and supplies them to the first printing device 20. The supply device 10 is electrically connected to the control device 60, and is driven under the control of the control device 60. As the alignment feeder 12, for example, a belt conveying mechanism can be used.

The transfer feeder 13 includes a conveyor belt 13*a*, a driving pulley 13*b*, a driven pulley 13*c*, a motor 13*d*, and a suction chamber 13*e*. The conveyor belt 13*a* is an endless belt and wrapped around the driving pulley 13*b* and the driven pulley 13*c*. The driving pulley 13*b* and the driven pulley 13*c* are rotatably provided to the apparatus main body, and the driving pulley 13*b* is connected to the motor 13*d*. The motor 13*d* is electrically connected to the control device 60, and is driven under the control of the control device 60. In the transfer feeder 13, the conveyor belt 13*a* is rotated together with the driven pulley 13*c* due to the rotation of the driving pulley 13*b* caused by the motor 13*d*, and the tablets T on the conveyor belt 13*a* are conveyed in the direction of arrow A1 in FIG. 2 (conveying direction A1).

A plurality of circular suction holes (not illustrated) are formed in the surface of the conveyor belt 13*a*. The suction holes are through holes for sucking and holding the tablets T, and are arrayed in a single line along the conveying direction A1 so as to form the conveying path P. Each of the suction holes is connected to the inside of the suction chamber 13*e* through a suction path (not illustrated) formed in the suction chamber 13*e* to obtain a suction force caused by the discharge of air from the suction chamber 13*e*. The air in the suction chamber 13*e* is discharged by the exhaust device 40 (described in detail later).

The suction path includes, for example, a slit-shaped through hole formed in the outer peripheral surface of the suction chamber 13*e* (the surface facing the conveyor belt 13*a*), or a groove-shaped recess formed in the outer peripheral surface of the suction chamber 13*e* (the surface facing the conveyor belt 13*a*) and a plurality of through holes formed in the bottom surface of the recess (the same applies to suction paths described below).

The first printing device 20 includes a conveyor 21, a detector 22, a first imaging unit (imager for printing) 23, an inkjet head 24, a second imaging unit (imager for inspection) 25, and a dryer 26.

The conveyor 21 includes a conveyor belt 21*a*, a driving pulley 21*b*, a plurality of driven pulleys 21*c* (three in the example of FIG. 2), a motor 21*d*, a position detector 21*e*, and a suction chamber 21*f*. The conveyor belt 21*a* is an endless belt, and wrapped around the driving pulley 21*b* and each of the driven pulleys 21*c*. The driving pulley 21*b* and the driven pulleys 21*c* are rotatably provided to the apparatus main body, and the driving pulley 21*b* is connected to the motor 21*d*. The motor 21*d* is electrically connected to the control device 60, and is driven under the control of the control device 60. The position detector 21*e* is a device such as an encoder and is attached to the motor 21*d*. The position detector 21*e* is electrically connected to the control device 60, and sends a detection signal to the control device 60. The control device 60 can obtain information such as the position, speed, and movement amount of the conveyor belt 21*a* based on the detection signal. In the conveyor 21, the conveyor belt 21*a* is rotated together with the driven pulleys 21*c* due to the rotation of the driving pulley 21*b* caused by the motor 21*d*, and the tablets T on the conveyor belt 21*a* are conveyed in the direction of arrow A1 in FIG. 2 (conveying direction A1).

A plurality of circular suction holes (not illustrated) are formed in the surface of the conveyor belt 21*a*. The suction holes are through holes for sucking and holding the tablets T, and are arrayed in a single line along the conveying direction A1 so as to form the conveying path P. Each of the suction holes is connected to the inside of the suction chamber 21*f* through a suction path formed in the suction chamber 21*f* to obtain a suction force caused by the discharge of air from the suction chamber 21*f*. The air in the suction chamber 21*f* is discharged by the exhaust device 40 (described in detail later).

The detector 22 is located on the downstream side of the position where the tablet T is supplied by the supply device 10 on the conveyor belt 21*a* in the conveying direction A1. The detector 22 is arranged above the conveyor belt 21*a*. The detector 22 detects the position (the position in the conveying direction A1) of the tablet T on the conveyor belt 21*a* by projecting and receiving laser beams, and functions as a trigger sensor for each device located on the downstream side. As the detector 22, various laser sensors such as reflection laser sensors can be used. The detector 22 is electrically connected to the control device 60, and sends a detection signal to the control device 60.

The first imaging unit 23 is located on the downstream side of the position where the detector 22 is located in the conveying direction A1. The first imaging unit 23 is arranged above the conveyor belt 21*a*. The first imaging unit 23 performs imaging at the time when the tablet T reaches just under the first imaging unit 23 based on the position information (the above-mentioned position) of the tablet T to capture an image (image for detecting the position of the tablet) including the upper surface of the tablet T, and sends the image to the control device 60. As the first imaging unit 23, various cameras having an imaging device such as a charge-coupled device (CCD) or a complementary metal-oxide semiconductor (CMOS) can be used. The first imaging unit 23 is electrically connected to the control device 60, and is driven under the control of the control device 60. There may also be provided an illumination for imaging as necessary.

The inkjet head 24 is located on the downstream side of the position where the first imaging unit 23 is located in the conveying direction A1. The inkjet head 24 is arranged above the conveyor belt 21*a*. The inkjet head 24 has a plurality of nozzles (not illustrated), and ejects ink from the nozzles individually. The inkjet head 24 is arranged such that the alignment direction of the nozzles crosses (for example, perpendicularly to) the conveying direction A1 in the horizontal plane. As the inkjet head 24, various inkjet print heads having a drive element such as a piezoelectric element, a heating element, a magnetostrictive element or the like can be used. The inkjet head 24 is electrically connected to the control device 60, and is driven under the control of the control device 60.

The second imaging unit 25 is located on the downstream side of the position where the inkjet head is located in the conveying direction A1. The second imaging unit 25 is arranged above the conveyor belt 21*a*. The second imaging unit 25 performs imaging at the time when the tablet T reaches just under the second imaging unit 25 based on the above-mentioned position information of the tablet T to capture an image (image for inspecting print quality) including the upper surface of the tablet T, and sends the image to the control device 60. Similarly to the first imaging unit 23, various cameras having an imaging device such as CCD or CMOS can be used as the second imaging unit 25. The second imaging unit 25 is electrically connected to the control device 60, and is driven under the control of the control device 60. There may also be provided an illumination for imaging as necessary.

The dryer 26 is located on the downstream side of the position where the inkjet head 24 is located in the conveying direction A1, and is arranged, for example, below the conveyor 21. The dryer 26 is configured to dry the ink applied to each tablet T on the conveyor belt 21*a*. As the dryer 26, various types of dryers such as a blower that dries an object with gas such as air, a heater that dries an object by radiation heat, a device consisting of a blower and a heater that dries an object with worm air or hot air, or the like can be used. The dryer 26 is electrically connected to the control device 60, and is driven under the control of the control device 60.

The tablet T passing above the dryer 26 is conveyed along with the movement of the conveyor belt 21*a* and reaches a position near the end of the conveyor belt 21*a* on the driven pulleys 21*c* side. At this position, the sucking action does not work on the tablet T. Accordingly, the tablet T is released from the hold of the conveyor belt 21*a*, and is transferred from the first printing device 20 to the second printing device 30.

Similarly to the first printing device 20 described above, the second printing device 30 includes a conveyor 31, a detector 32, a first imaging unit (imager) 33, an inkjet head 34, a second imaging unit (imager) 35, and a dryer 36. The conveyor 31 includes a conveyor belt 31*a*, a driving pulley 31*b*, a plurality of driven pulleys 31*c* (three in the example of FIG. 2), a motor 31*d*, a position detector 31*e*, and a suction chamber 31*f*. Each constituent element of the second printing device 30 has basically the same structure as the corresponding constituent element of the first printing device 20 described above. Therefore, the explanation will be omitted. In FIG. 2, arrow A2 indicates the conveying direction of the second printing device 30 (conveying direction A2).

As illustrated in FIG. 1, the exhaust device 40 includes the exhaust box 41, the exhaust pipes 42 to 45 (four pipes in the example of FIG. 1), and the exhaust blower 46.

The exhaust box 41 is provided in the second chamber 5*b* of the housing 5. The exhaust box 41 functions as a chamber where the air discharged individually from each of the suction chambers 13*e*, 21*f*, and 31*f* is mixed together.

The exhaust pipe 42 connects the suction chamber 13*e* of the transfer feeder 13 and the exhaust box 41. One end of the exhaust pipe 42 is connected to substantially the center of a side surface (a surface parallel to the conveying direction A1 in FIG. 2) of the suction chamber 13*e*, and the other end is connected to the exhaust box 41. The exhaust pipe 42 is arranged in such a manner as to extend from the first chamber 5*a* to the second chamber 5*b* passing through the partition plate 6.

The exhaust pipe 43 connects the suction chamber 21*f* of the conveyor 21 and the exhaust box 41. One end of the exhaust pipe 43 is connected to substantially the center of a side surface (a surface parallel to the conveying direction A1 in FIG. 2) of the suction chamber 21*f*, and the other end is connected to the exhaust box 41. Similarly to the exhaust pipe 42 described above, the exhaust pipe 43 is arranged in such a manner as to extend from the first chamber 5*a* to the second chamber 5*b* passing through the partition plate 6.

The exhaust pipe 44 connects the suction chamber 31*f* of the conveyor 31 and the exhaust box 41. One end of the exhaust pipe 44 is connected to substantially the center of a side surface (a surface parallel to the conveying direction A1 in FIG. 2) of the suction chamber 31*f*, and the other end is connected to the exhaust box 41. Similarly to the exhaust pipes 42 and 43 described above, the exhaust pipe 44 is arranged in such a manner as to extend from the first chamber 5*a* to the second chamber 5*b* passing through the partition plate 6.

The exhaust pipe 45 is arranged in the second chamber 5*b*. One end of the exhaust pipe 45 is connected to the exhaust box 41. The exhaust pipe 45 extends from the exhaust box 41 to the outside of the housing 5 and further to the outside of the installation room (the room where the housing 5 is installed). Thus, the exhaust port of the exhaust pipe 45 is located outside the installation room.

The exhaust blower 46 has a built-in motor 46*a*, and applies pressure to the air in the exhaust pipe 45 by the operation of the motor 46*a* to send it out. The exhaust blower 46 is connected to the exhaust pipe 45 so that it can discharge the air in the exhaust box 41 connected to the exhaust pipe 45, i.e., the air in each of the suction chambers 13*e*, 21*f*, and 31*f* connected to the exhaust box 41 through the exhaust pipes 42 to 44, to the outside of the installation room. Thereby, the air in each of the suction chambers 13*e*, 21*f*, and 31*f* is discharged, and a suction force for sucking and holding the tablet T is applied to each of the conveyor belts 13*a*, 21*a*, and 31*a*. The motor 46*a* is electrically connected to the control device 60, and is driven under the control of the control device 60. Since the motor 46*a* generates heat, the exhaust blower 46 is a heat source that generates heat.

A heat conductive member 70 is located near the exhaust blower 46 described above. The heat conductive member 70 is an L-shaped plate-like member having heat conductivity. One end face (one end part) of the heat conductive member 70 is connected to the exhaust blower 46, and the other end face (the other end part) is connected to the exhaust pipe 45. The heat conductive member 70 is arranged in the second chamber 5*b*, and is in contact with only the side surface of the exhaust blower 46 and the upper surface of the exhaust pipe 45. The heat conductive member 70 transfers heat from the exhaust blower 46 (a heat source) to the exhaust pipe 45 and transfers the heat from the exhaust pipe 45 to the air flowing through the exhaust pipe 45 to discharge the heat with the air flowing through the exhaust pipe 45. As the heat conductive member 70, for example, a heat-conducting plate or a heat pipe may be used. It is preferable that the heat conductive member 70 be made of a metal or the like that has a high heat conductivity, such as aluminum or iron.

Figure 3:
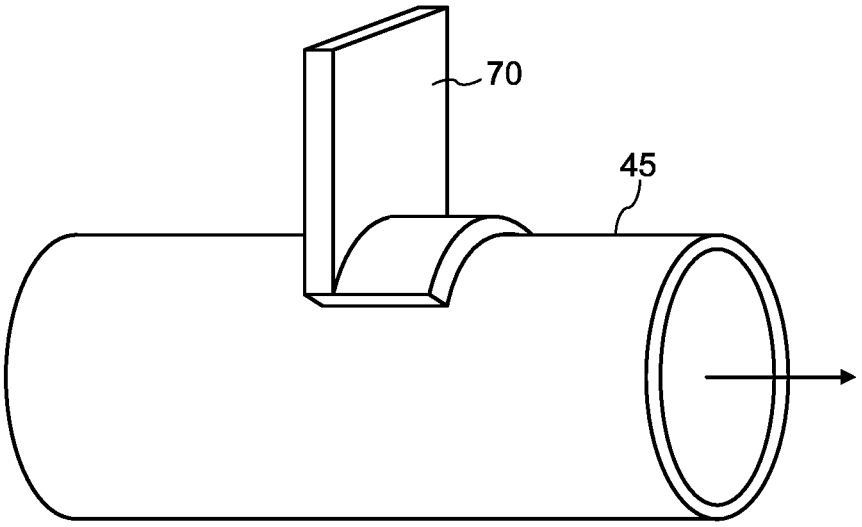
FIG. 3 is a diagram illustrating an example of a heat conductive member of the first embodiment.
Figure 4:
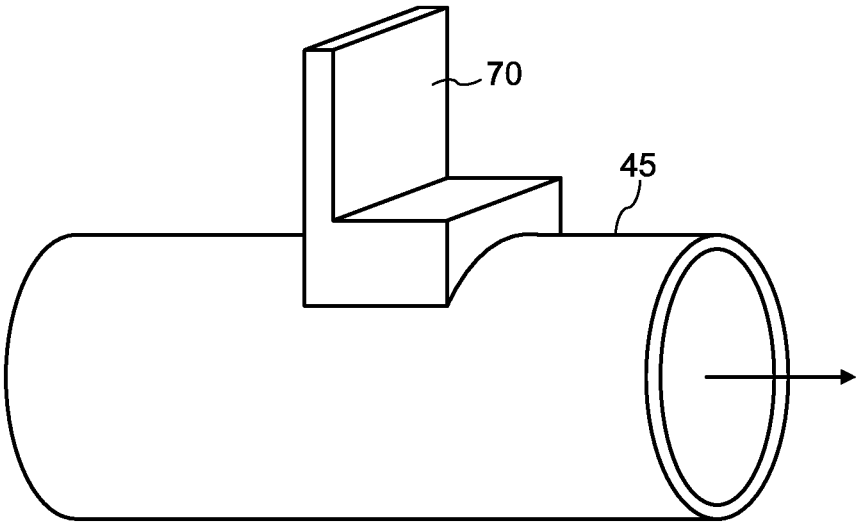
FIG. 4 is a diagram illustrating another example of the heat conductive member of the first embodiment.
Figure 5:
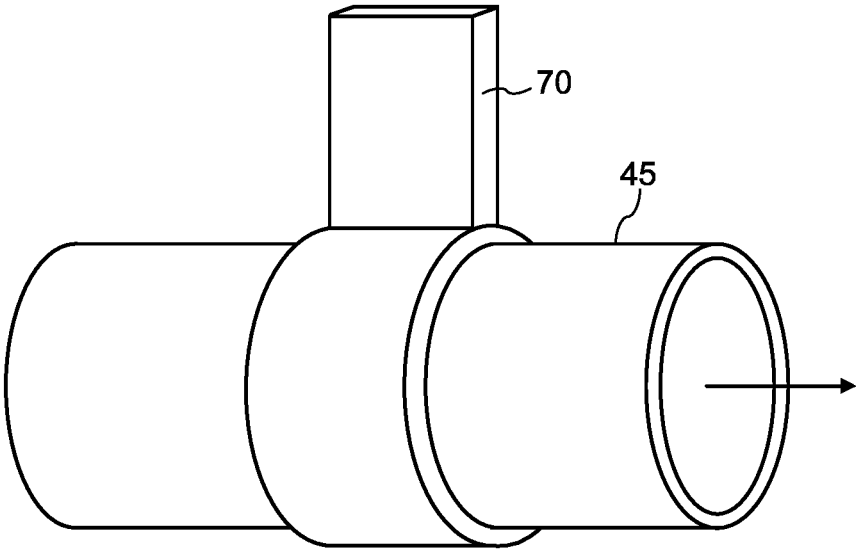
FIG. 5 is a diagram illustrating still another example of the heat conductive member of the first embodiment.

The heat conductive member 70 need not necessarily be an L-shaped plate-like member as illustrated in FIGS. 3 and 4, and may be formed in a shape that wraps around the outer periphery of the exhaust pipe 45 as illustrated in FIG. 5. The heat conductive member 70 illustrated in FIG. 5 has a larger contact area with the exhaust pipe 45 as compared to that of the heat conductive member 70 illustrated in FIG. 3 or 4. An increase in the contact area between the heat conductive member 70 and the exhaust pipe 45 can improve the heat conduction efficiency. In FIGS. 3 and 4, one end face (lower surface in the Figures) of the heat conductive member is formed to fit the shape of the outer periphery of the exhaust pipe 45, and is entirely in contact with the outer periphery of the exhaust pipe 45. Besides, the heat conductive member 70 illustrated in FIG. 3 has a smaller surface area than the heat conductive member 70 illustrated in FIG. 4. A reduction in the surface area of the heat conductive member 70 results in the heat conductive member 70 having less contact area with the air. Thus, the amount of heat released from the heat conductive member 70 to the air in the second chamber 5*b* can be reduced.

Referring back to FIG. 2, the collecting device includes a defective product collecting device (collector) 51 and a non-defective product collecting device (collector) 52. The collecting device 50 collects defective tablets T (for example, tablets that are chipped or cracked, tablets with print defects, etc.) by the defective product collecting device 51 and collects non-defective tablets T by the non-defective product collecting device 52.

The defective product collecting device 51 includes an injection nozzle 51*a* and a container 51*b*. The injection nozzle 51*a* is provided in the suction chamber 31*f*. The injection nozzle 51*a* injects a gas (for example, air) toward a defective tablet T conveyed by the conveyor belt 31*a* to drop it from the conveyor belt 31*a*. At this time, the gas injected from the injection nozzle 51*a* passes through suction holes (not illustrated) of the conveyor belt 31*a* and hits the defective tablet T. The injection nozzle 51*a* is electrically connected to the control device 60, and is driven under the control of the control device 60. The container 51*b* receives and stores the defective tablet T dropped from the conveyor belt 31*a*.

The non-defective product collecting device 52 includes a gas blower 52*a* and a container 52*b*. The gas blower 52*a* is arranged in the conveyor 31 at the end of the conveyor 31, i.e., at the end of the conveyor belt 31*a* on the driven pulleys 31*c* side. During the printing process, for example, the gas blower 52*a* constantly blows a gas (for example, air) toward the conveyor belt 31*a* to drop non-defective tablets T from the conveyor belt 31*a*. At this time, the gas blown out from the gas blower 52*a* passes through suction holes (not illustrated) of the conveyor belt 31*a* and hits the non-defective tablet T. Examples of the gas blower 52*a* include an air blower having a slit-shaped opening extending in a direction crossing the conveying direction A2 (for example, a direction perpendicular to the conveying direction A2) in the horizontal plane. The gas blower 52*a* is electrically connected to the control device 60, and is driven under the control of the control device 60. The container 52*b* receives and stores the non-defective tablets T dropped from the conveyor belt 31*a*.

The control device 60 includes an image processor 61, a print processor 62, an inspection processor 63, and a memory 64. The image processor 61 processes an image. The print processor 62 performs processing related to printing. The inspection processor 63 performs processing related to inspection. The memory 64 stores various information such as processing information and various programs. As the processors 61 to 63, for example, a central processing unit (CPU) may be used. Examples of the memory 64 include a random access memory (RAM) and a read only memory (ROM). The control device 60 controls the supply device 10, the first printing device 20, the second printing device 30, the exhaust device 40, and the collecting device 50. The control device 60 receives position information of the tablets T sent from each of the detectors 22 and 32 of the first printing device 20 and the second printing device 30, images sent from each of the imaging units 23, 25, 33 and 35 of the first printing device 20 and the second printing device 30, and the like. Since the processors 61 to 63 generate heat, the control device 60 is a heat source that generates heat.

As illustrated in FIG. 1, a heat conductive member 71 is located around the control device 60. The heat conductive member 71 is an I-shaped plate-like member having heat conductivity. One end face (one end part) of the heat conductive member 71 is connected to the control device 60, and the other end face (the other end part) is connected to the exhaust pipe 45. The heat conductive member 71 is arranged in the second chamber 5*b*, and is in contact with only the upper surface of the control device 60 and the lower surface of the exhaust pipe 45. The heat conductive member 71 transfers heat from the control device 60 (a heat source) to the exhaust pipe 45 and transfers the heat from the exhaust pipe 45 to the air flowing through the exhaust pipe 45 to discharge the heat with the air flowing through the exhaust pipe 45. As in the case of the heat conductive member 70 described above, for example, a heat-conducting plate or a heat pipe may be used as the heat conductive member 71. It is preferable that the heat conductive member 71 be made of a metal or the like that has a high heat conductivity, such as aluminum or iron. The heat conductive member 71 need not necessarily be an I-shaped plate-like member, and may be formed in any of the shapes illustrated in FIGS. 3 to 5, as with the heat conductive member 70.

In the tablet printing apparatus 1 configured as above, the supply device 10 sequentially supplies the tablets T to the first printing device 20. In the first printing device 20, the tablets T pass under the detector 22, the first imaging unit 23, the inkjet head 24, and the second imaging unit 25, and then pass above the dryer 26 as being conveyed by the conveyor 21. During this time, a series of process steps: detection, imaging, printing, imaging, and drying of the tablets T are performed. After the process, the tablets T are transferred from the conveyor 21 of the first printing device 20 to the conveyor 31 of the second printing device 30. The tablets T pass under the detector 32, the first imaging unit 33, the inkjet head 34, and the second imaging unit 35, and then pass above the dryer 36 as being conveyed by the conveyor 31. During this time, a series of process steps: detection, imaging, printing, imaging, and drying of the tablets T are performed. After the process, the tablets T are collected by the collecting device 50. In this manner, printing is performed on both sides of the tablets T. There may be a case where one of the two printing processes described above is not performed, and printing is performed on only one side of the tablets T.

In those printing processes, the transfer feeder 13, and the conveyors 21 and 31 convey the tablets T while sucking and holding them by the discharge of air (by venting the internal air to the outside). The exhaust blower 46 discharges the air in each of the suction chambers 13*e*, 21*f*, and 31*f* of the transfer feeder 13, and the conveyors 21 and 31, thereby providing the transfer feeder 13, and the conveyors 21 and 31 with a suction force for sucking and holding the tablets T. More specifically, the inside of each of the suction chambers 13*e*, 21*f*, and 31*f* is depressurized by the operation of the exhaust blower 46, and a suction force acts on suction holes of each of the conveyor belts 13*a*, 21*a*, and 31*a*.

During the printing processes, the exhaust blower 46 keeps operating, and also the control device 60 controls each unit. The air in the suction chambers 13*e*, 21*f*, and 31*f* of the transfer feeder 13, and the conveyors 21 and 31 is discharged by the operation of the exhaust blower 46 through the exhaust pipes 42 to 44, and is mixed together in the exhaust box 41. The mixed air flows through the exhaust pipe 45 to the outside of the installation room. The heat generated in the exhaust blower 46 is transferred to the exhaust pipe 45 through the heat conductive member 70. The heat transferred to the exhaust pipe 45 is transferred to the air flowing through the exhaust pipe 45, and is discharged out of the installation room. Besides, the heat generated in the control device 60 is transferred to the exhaust pipe 45 through the heat conductive member 71. The heat transferred to the exhaust pipe 45 is transferred to the air flowing through the exhaust pipe 45, and is discharged out of the installation room. As described above, the heat generated in the housing 5 is discharged to the outside of the housing 5. Thereby, a rise in temperature can be suppressed in the housing 5. This prevents ink drying at the nozzle tip of the inkjet head 24 and around the nozzles due to a temperature rise, thereby suppressing the ejection failure of the inkjet head 24. Thus, it is possible to reduce the production of tablets T with print defects, resulting in an increase in productivity.

The inside of the housing 5 is divided into the first chamber 5*a* and the second chamber 5*b* by the partition plate 6; however, both rooms are substantially the same temperature due to the flow of air. Besides, since the heat flows from a higher temperature to a lower temperature, the temperature rise in the first chamber 5*a* can be indirectly controlled by controlling the temperature rise in the second chamber 5*b*. It is desirable that temperatures in the housing 5 be, for example, as follows: 30° C. or lower around the inkjet head 24, 40° C. or lower in the surrounding area of the control device 60, and about to 25° C. on average inside the housing 5. Without the heat conductive members 70 and 71, the average temperature in the housing 5 exceeds 26° C., and the above temperature environment cannot be realized. Whereas, the use of the heat conductive members 70 and enables a decrease in the average temperature in the housing 5 by about 1 to 3° C., and thus the above temperature environment can be achieved.

The temperature rise in the housing 5 can also be suppressed by providing the exhaust blower 46 outside the housing 5 in the installation room. However, if the exhaust blower 46 is located outside the housing 5 in the installation room, then that causes an increase in the entire size of the tablet printing apparatus 1, and also the temperature of the installation room rises due to the presence of the exhaust blower 46. In addition, vibration-proof and sound-proof materials are required to provide the exhaust blower 46 in the installation room, which increases the cost of the apparatus. Meanwhile, the housing 5 is originally vibration and sound proofed. Therefore, when the exhaust blower 46 is located in the housing 5, it is possible to reduce the size and cost of the apparatus.

As described above, according to the first embodiment, a heat conductive member (for example, the heat conductive members 70 and 71) is arranged in the housing 5 so as to be in contact with a heat source (for example, the exhaust blower 46, the control device 60) and the exhaust pipe 45. With this, the heat generated by the heat source is transferred to the exhaust pipe 45 through the heat conductive member. The heat transferred to the exhaust pipe 45 is transferred to the air flowing through the exhaust pipe 45, and is discharged to the outside of the installation room. Thereby, a rise in temperature can be suppressed in the housing 5. This prevents ink drying at the nozzle tip of the inkjet head 24 and around the nozzles, thereby suppressing the ejection failure of the inkjet head 24. Thus, it is possible to reduce the production of tablets with print defects, resulting in an increase in productivity.

Second Embodiment

The second embodiment will be described with reference to FIGS. 6 and 7. In the second embodiment, only differences from the first embodiment (heat dissipation member) will be described, and the same description will not be repeated.

Figure 6:
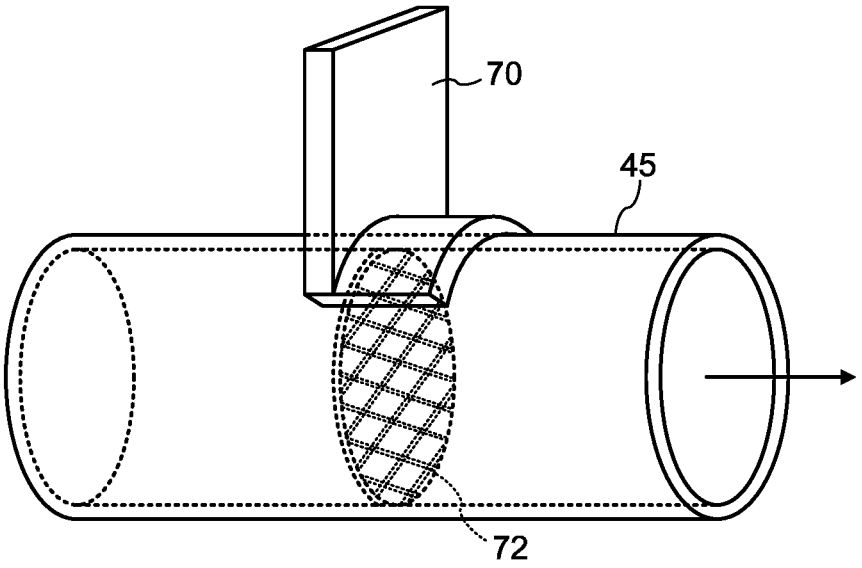
FIG. 6 is a diagram illustrating an example of a heat dissipation member according to a second embodiment.
Figure 7:
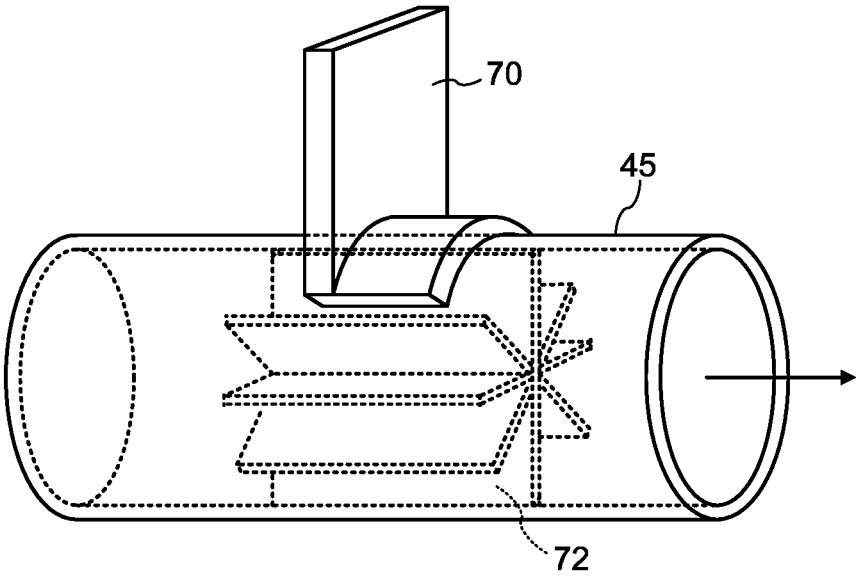
FIG. 7 is a diagram illustrating another example of the heat dissipation member of the second embodiment.

As illustrated in FIG. 6 or 7, in the second embodiment, a heat dissipation member 72 is arranged in the exhaust pipe 45 so as to be in contact with the exhaust pipe 45. The heat dissipation member 72 is located in a position facing the heat conductive member 70 outside the exhaust pipe 45, for example, a position facing the contact area where the heat conductive member 70 is in contact with the exhaust pipe 45 (a position within the contact range). The heat dissipation member 72 has heat conductivity and is a member for dissipating heat. The heat dissipation member 72 is made of, for example, mesh as illustrated in FIG. 6 or blades as illustrated in FIG. 7 so as to suppress a decrease in the flow rate of the air flowing through the exhaust pipe 45, i.e., the exhaust efficiency. By arranging the heat dissipation member so as to face the heat conductive member 70, the heat is more easily transferred from the heat conductive member 70 to the heat dissipation member 72.

The heat dissipation member 72 need not necessarily be made of a mesh material or a blade-like material, and may be formed with one or a plurality of plate members. In this case, for example, the plate member(s) is/are provided on the inner peripheral surface of the exhaust pipe 45 (for example, the inner peripheral surface on the heat conductive member 70 side) so as to extend parallel to the extending direction of the exhaust pipe 45. The plate members are arranged in either or both of the extending direction and the circumferential direction of the exhaust pipe 45. The less plate members used, the more preferable for the purpose of suppressing a decrease in exhaust efficiency.

The heat dissipation member 72 transfers the heat that has been transferred from the heat conductive member 70 to the exhaust pipe 45 to the air flowing through the exhaust pipe 45 and thereby dissipates it. The heat dissipation member 72 is located in the exhaust pipe 45, and the air flowing through the exhaust pipe 45 comes in contact with the heat dissipation member 72 in the exhaust pipe 45. Accordingly, the heat transferred to the exhaust pipe is more easily transferred to the air flowing through the exhaust pipe 45 as compared to the case without the heat dissipation member 72, and is quickly discharged to the outside of the installation room. Thereby, a rise in temperature can be reliably suppressed in the housing 5. This prevents ink drying at the nozzle tip of the inkjet head 24 and around the nozzles, thereby suppressing the ejection failure of the inkjet head 24. Thus, it is possible to reduce the production of tablets with print defects, resulting in a reliable increase in productivity.

As described above, according to the second embodiment, the same effects as described in the first embodiment can be achieved. Further, the heat dissipation member 72 is arranged in the exhaust pipe so as to be in contact with the exhaust pipe 45. With this, the heat that has been transferred from the heat conductive member 70 to the exhaust pipe 45 can be easily transferred to the air flowing through the exhaust pipe 45. As a result, a rise in temperature can be reliably suppressed in the housing 5. This prevents ink drying at the nozzle tip of the inkjet head 24 and around the nozzles, thereby suppressing the ejection failure of the inkjet head 24. Thus, it is possible to reduce the production of tablets with print defects, resulting in a reliable increase in productivity.

Besides, by arranging the heat dissipation member 72 in the exhaust pipe 45 so as to face the heat conductive member 70, the heat that has been transferred from the heat conductive member 70 to the exhaust pipe 45 is quickly transferred to the heat dissipation member 72, thereby improving the efficiency of heat dissipation. This reliably suppresses the temperature rise in the housing 5, and thus more reliably increases the productivity.

Other Embodiments

In the above embodiments, the exhaust blower 46 and the control device (controller) 60 are cited as examples of heat sources; however, heat sources are not limited to them. Other elements such as the motors 13*d*, 21*d*, and 31*d* can also be heat sources, and the motors 13*d*, 21*d*, and 31*d* may be connected to the exhaust pipe 45 by a heat conductive member. In addition, the heat source need not necessarily be the motor alone, but may be a motor device having a motor that generates heat and a cover that houses the motor. In this case, the cover may be connected to the exhaust pipe 45 by a heat conductive member.

In the above embodiments, the heat source is described as being connected to the exhaust pipe 45 by each of the heat conductive members 70 and 71. However, this is by way of example and not limitation. The heat source may be connected to any of the exhaust pipes 42 to 44.

In the above embodiments, one exhaust pipe 45 is provided so as to extend from the exhaust box 41 to the outside of the installation room. However, this is by way of example and not limitation. There may be a plurality of exhaust pipes. In this case, each of the exhaust pipes may be provided with the exhaust blower 46. Although the number of exhaust blowers is not particularly limited, it is desirable that each of the exhaust blowers (46) be provided with the heat conductive member 70.

In the above embodiments, the air is described as being discharged out of the housing 5 to the outside of the installation room. However, this is by way of example and not limitation. The air may be discharged out of the housing 5 and inside the installation room. However, if the air is discharged out of the housing 5 and inside the installation room, the environment of the installation room may degrade (for example, the temperature may increase). Therefore, it is desirable that the air be discharged to the outside of the installation room.

In the above embodiments, only one heat dissipation member 72 is arranged in the exhaust pipe 45. However, this is by way of example and not limitation. There may be a plurality of heat dissipation members. Besides, although the heat dissipation member 72 is described as being arranged in the exhaust pipe 45 so as to face the heat conductive member 70, this is by way of example and not limitation. The heat dissipation member 72 may be located in another place in the exhaust pipe 45.

The tablets T are described above as being conveyed in a row; however, this is by way of example and not limitation. The number of rows is not particularly limited, and there may be two rows, three rows, or four or more rows. In addition, the number of conveying paths (P) and the number of conveyor belts (21*a*, 31*a*) are also not particularly limited.

An inkjet print head in which nozzles are arranged in a row is exemplified above as the inkjet head 24; however, this is by way of example and not limitation. For example, a print head in which nozzles are arranged in a plurality of rows may be used. Further, a plurality of inkjet heads may be arranged along a direction perpendicular to the conveying direction A1 in the horizontal plane.

In the above embodiments, there are provided the dryers 26 and 36; however, this is by way of example and not limitation. The number of the dryers is not particularly limited. Further, dryers 26 and 36 may not be required depending on the type of ink or tablets T. In such cases, the dryers 26 and 36 may be eliminated.

The first printing device 20 and the second printing device 30 are described above as being arranged one on top of the other to perform printing on either one or both sides of the tablet T; however, this is by way of example and not limitation. For example, only the first printing device 20 may be provided to perform printing only on one side of the tablet T.

The above-described tablets may include tablets for pharmaceutical use, edible use, cleaning, industrial use, and aromatic use. Examples of the tablets include plain tablets (uncoated tablets), sugar-coated tablets, film-coated tablets, enteric coated tablets, gelatin coated tablets, multilayered tablets, dry-coated tablets, and the like. Examples of the tablets further include various capsule tablets such as hard capsules and soft capsules. The tablets may be in a variety of shapes such as, for example, a disk shape, a lens shape, a triangle shape, an oval shape, and the like. In the case where tablets to be printed are for pharmaceutical use or edible use, edible ink is suitably used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a conveyor configured to convey a tablet while sucking and holding the tablet by discharge of air;

an inkjet head configured to perform printing on the tablet conveyed by the conveyor;

an exhaust pipe which the air discharged from the conveyor passes through;

a heat source that generates heat;

a heat conductive member that is in contact with the exhaust pipe and the heat source; and a housing configured to house the conveyor, the inkjet head, the exhaust pipe, the heat source, and the heat conductive member.

2. The tablet printing apparatus according to claim 1, further comprising a heat dissipation member that is arranged in the exhaust pipe so as to be in contact with the exhaust pipe.

3. The tablet printing apparatus according to claim 2, wherein the heat dissipation member is located in a position facing the heat conductive member.

4. The tablet printing apparatus according to claim 2, wherein the heat dissipation member is made of a mesh material or a blade-like material.

5. The tablet printing apparatus according to claim 3, wherein the heat dissipation member is made of a mesh material or a blade-like material.

6. The tablet printing apparatus according to claim 1, wherein the heat conductive member has an exhaust-pipe-side end formed in a shape that wraps around an outer periphery of the exhaust pipe.

7. The tablet printing apparatus according to claim 2, wherein the heat conductive member has an exhaust-pipe-side end formed in a shape that wraps around an outer periphery of the exhaust pipe.

8. The tablet printing apparatus according to claim 3, wherein the heat conductive member has an exhaust-pipe-side end formed in a shape that wraps around an outer periphery of the exhaust pipe.

9. The tablet printing apparatus according to claim 1, wherein the heat source is an exhaust blower configured to discharge the air from the conveyor.

10. The tablet printing apparatus according to claim 1, wherein the heat source is a controller configured to control either or both of the conveyor and the inkjet head.

11. The tablet printing apparatus according to claim 1, wherein the exhaust pipe extends to outside of an installation room where the housing is installed.

12. The tablet printing apparatus according to claim 1, wherein the housing is divided into a first chamber and a second chamber by a partition wall, the inkjet head is located in the first chamber, and the heat source is located in the second chamber.

13. The tablet printing apparatus according to claim 12, wherein the exhaust pipe includes a plurality of exhaust pipes, and the second chamber includes an exhaust box where air flowing through the exhaust pipes is mixed to be discharged together.

14. A heat dissipation method of a tablet printing apparatus that comprises a conveyor configured to convey a tablet while sucking and holding the tablet by discharge of air, an inkjet head configured to perform printing on the tablet conveyed by the conveyor, an exhaust pipe which the air discharged from the conveyor passes through, a heat source that generates heat, and a housing configured to house the conveyor, the inkjet head, the exhaust pipe, and the heat source, the method comprising:

transferring the heat generated by the heat source to the exhaust pipe through a heat conductive member that is arranged in contact with the exhaust pipe and the heat source.

15. The heat dissipation method according to claim 14, further comprising arranging a heat dissipation member in the exhaust pipe so as to be in contact with the exhaust pipe.

16. The heat dissipation method according to claim 15, wherein the heat dissipation member is located in a position facing the heat conductive member.

17. The heat dissipation method according to claim 15, wherein the heat dissipation member is made of a mesh material or a blade-like material.

18. The heat dissipation method according to claim 14, wherein the heat source is an exhaust blower configured to discharge the air from the conveyor, and the heat generated by the exhaust blower is transferred to the exhaust pipe through the heat conductive member that is arranged in contact with the exhaust pipe and the exhaust blower.

19. The heat dissipation method according to claim 14, wherein the heat source is a controller configured to control either or both of the conveyor and the inkjet head, and the heat generated by the controller is transferred to the exhaust pipe through the heat conductive member that is arranged in contact with the exhaust pipe and the controller.

20. The heat dissipation method according to claim 14, wherein the exhaust pipe extends to outside of an installation room where the housing is installed.

* * * * *